US010078946B2

(12) United States Patent
Goulet

(10) Patent No.: US 10,078,946 B2
(45) Date of Patent: Sep. 18, 2018

(54) COMMISSIONING OF ELECTRO-OPTICAL DETECTOR

(71) Applicant: Xtralis AG, Uznach (CH)

(72) Inventor: Thomas Goulet, Unterageri (CH)

(73) Assignee: Xtralis AG, Uznach (CH)

( * ) Notice: Subject to any disclaimer, the term of this patent is extended or adjusted under 35 U.S.C. 154(b) by 0 days.

(21) Appl. No.: 15/111,625

(22) PCT Filed: Jan. 16, 2015

(86) PCT No.: PCT/EP2015/050793
§ 371 (c)(1),
(2) Date: Jul. 14, 2016

(87) PCT Pub. No.: WO2015/107157
PCT Pub. Date: Jul. 23, 2015

(65) Prior Publication Data

US 2016/0343222 A1 Nov. 24, 2016

(30) Foreign Application Priority Data

Jan. 17, 2014 (AU) ..... 2014900175

(51) Int. Cl.
*G08B 13/19* (2006.01)
*G08B 13/196* (2006.01)
*G08B 13/191* (2006.01)

(52) U.S. Cl.
CPC ..... *G08B 13/19619* (2013.01); *G08B 13/191* (2013.01); *G08B 13/1963* (2013.01); *G08B 13/19689* (2013.01)

(58) Field of Classification Search
CPC ..... G08B 13/19619; G08B 13/191; G08B 13/1963; G08B 13/19689
See application file for complete search history.

(56) References Cited

U.S. PATENT DOCUMENTS 8,137,007 B1 3/2012 Harvey
2010/0157053 A1* 6/2010 Helmes ..... H04N 5/2252 348/143

(Continued)

FOREIGN PATENT DOCUMENTS

WO WO-9102287 A1 2/1991
WO WO-2006012524 A2 2/2006

OTHER PUBLICATIONS

"International Application No. PCT/EP2015/050793, International Search Report dated Jun. 30, 2015", (Jun. 30, 2015), 6 pgs.

(Continued)

*Primary Examiner* — W B Perkey
(74) *Attorney, Agent, or Firm* — Schwegman Lundberg & Woessner, P.A.

(57) ABSTRACT

An electro-optical detector is provided. The detector includes a mounting support adapted to be secured to a fixed structure and an alignable component which is connected to the mounting support through an adjustment mechanism capable of altering the relative position of the alignable component during commissioning of the detector. The detector further has a detachable controller unit including a communication module which receives instructions from a remote communication device in response to which the adjustment mechanism alters the alignable component's position relative to the mounting support.

15 Claims, 6 Drawing Sheets

(56) References Cited

U.S. PATENT DOCUMENTS

2014/0118554 A1* 5/2014 Bucknor ..... H04N 5/2251
348/155
2014/0354821 A1* 12/2014 Monroe ..... H04N 7/18
348/159

OTHER PUBLICATIONS

"International Application No. PCT/EP2015/050793, Written Opinion dated Jun. 30, 2015", (Jun. 30, 2015), 7 pgs.

* cited by examiner

COMMISSIONING OF ELECTRO-OPTICAL DETECTOR

PRIORITY APPLICATIONS

This application is a U.S. National Stage Filing under 35 U.S.C. 371 from International Application No. PCT/EP2015/050793, filed on 16 Jan. 2015, and published as WO 2015/107157 on 23 Jul. 2015, which claims the benefit of priority of Australian Application No. 2014900175, filed on 17 Jan. 2014; which applications and publication are incorporated herein by reference in their entirety.

FIELD OF THE INVENTION

The present invention relates to an electro-optical detector and the commissioning thereof. More particularly, although not exclusively, the invention relates to a passive infrared (PIR) detector mounted to a fixed structure. The invention is however not limited to this particular application and other types of detectors and their commissioning prior to use, are included within the scope of the present invention.

BACKGROUND OF THE INVENTION

Electro-optical detectors, such as PIR detectors, are widely used in security systems. These detectors are often mounted to fixed structures, such as poles or walls, and when commissioned the detectors monitor narrow curtain-shaped fields or corridors against intrusion.

The relative alignment or positioning of a detector determines the field of view of the detector, i.e. the area to be monitored. Standard practice is for technicians to manually align, both in the vertical and horizontal planes, the detectors during a commissioning phase. During such manual alignment process, two technicians have to work together, with one technician performing a walk test through the field of detection, while the other makes iterative manual adjustments to the alignment of the detector.

The operation and sensitivity of the security systems that include this type of detector are very much dependent on the accurate manual commissioning of the detectors. If commissioning of a unit is not sufficiently accurate in accordance with the desired field of view, the likelihood of false alarms increases which ultimately results in an unreliable security system.

Manual alignment of detectors in the vertical plane is of particular importance as the depth range of the detector, mounted at a height of 4 meters, may vary by 70 meters if the detector is tilted by only 1° with the horizontal. This type of sensitivity in alignment is not easy to control during a manual commissioning process.

From the above it is evident that the current manual commissioning process used for electro-optical detectors is inadequate as it is labour intensive, time consuming and expensive.

It is an object of the present invention to provide an electro-optical detector adapted to address this shortcoming. Alternatively, or in addition, it would be desirable to provide the public with a useful choice.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

In accordance with a first aspect of the present invention, there is provided an electro-optical detector including:

a mounting support adapted to be secured to a fixed structure;

an alignable component, the alignable component being connected to the mounting support through an adjustment mechanism capable of altering the relative position of the alignable component during commissioning of the detector; and a detachable controller unit including a communication module to receive instructions from a remote communication device in response to which the adjustment mechanism alters the alignable component's position relative to the mounting support.

The alignable component may be any component of the detector that is used to define a field of view of the detector. For example, the alignable component may be a detector head including electro-optical detector circuitry having a field of view, or an optical component or system including a lens, mirror, prism or the like, wherein the position and/or orientation relative to the mounting support defines a field of view or field of illumination of the alignable component of the detector.

The detachable controller unit may include an actuator driven in response to the received instructions and interacting with the adjustment mechanism of the detector. Preferably, the actuator is a motor drive.

The actuator may be configured to mechanically engage with the adjustment mechanism of the detector. Preferably, the adjustment mechanism locks the alignable component in place on removal of the detachable controller unit.

The communication module may be a wireless communication module.

In accordance with a second aspect of the invention, there is provided a commissioning tool kit for an electro-optical detector including a mounting support and an alignable component connected to each other through an adjustment mechanism configured to alter the relative position between the mounting support and the alignable component, the commissioning tool kit including:

a commissioning module executable on a remote communication device, the commissioning module configured to receive and process inputs from a user to control an orientation of the alignable component, the commissioning module further adapted to communicate the inputs as instructions to a detachable controller unit, and a detachable controller unit configured to be connectable to the electro-optical detector, the controller unit including a communication module to receive the instructions from the remote communication device in response to which the adjustment mechanism is controlled.

The alignable component may be any component of the detector that is used to define a field of view of the detector. For example, the alignable component may be a detector head including electro-optical detector circuitry having a field of view, or an optical component or system including a lens, mirror, prism or the like, wherein the position and/or orientation relative to the mounting support defines a field of view or field of illumination of the alignable component of the detector.

The detachable controller unit may include an actuator driven in response to the received instructions and interacting with the adjustment mechanism of the detector. Preferably, the actuator is a motor drive.

The actuator may be configured to mechanically engage with the adjustment mechanism of the detector.

The adjustment mechanism may lock the alignable component in place on removal of the detachable controller unit.

In accordance with a third aspect of the invention there is provided a method of commissioning a mounted electro-optical detector having an alignable component connected to a mounting support through an adjustment mechanism, the method including, at the electro-optical detector.

connecting a detachable controller unit to the adjustment mechanism of the detector;

at the detachable controller unit, receiving instructions to adjust the relative position of the alignable component from a remote communication device; and in response to the received instructions, driving an actuator that interacts with the adjustment mechanism to alter the alignable component's relative position thereby to adjust the field of view of the detector.

In accordance with yet another aspect of the invention there is provided a cable gland assembly located in a component housing, the cable gland assembly comprising a cable gland seat to receive a flexible cable gland, the seat being defined by an outer wall extending into the interior of the housing and an inner rim which defines a cable entry passage extending through the seat; and a flexible cable gland having one or more cable ducts defined therein, each cable duct being connected to the periphery of the gland by a duct connector slot and configured to fit around a cable section, wherein each of the seat and cable gland is shaped and sized for the seat to snugly receive the cable gland in use.

The seat and cable gland may be shaped and sized to receive the cable gland in a configuration where the one or more cable ducts and connector slots are closed. Preferably, the seat and cable gland are shaped and sized in order for the one or more cable ducts and/or duct connector slots to be biased closed thereby providing any cable received in a duct with a tight fit.

In addition, or alternatively, the seat and cable gland may be shaped and sized for the seat to receive the cable gland in a deformed configuration, thereby forcing the bias of the gland.

Typically, each cable duct has an associated cable stop which plugs the cable duct when not yet used. Each associated cable stop may be secured to the cable duct.

The diameter of the cable duct may be less than the diameter of a cable to be received by the cable duct. This ensures that the cable fits snugly in the gland restricting the ingress of water or dust into the component housing.

As used herein, except where the context requires otherwise, the term "comprise" and variations of the term, such as "comprising", "comprises" and "comprised", are not intended to exclude further additives, components, integers or steps.

Further aspects of the present invention and further embodiments of the aspects described in the preceding paragraphs will become apparent from the following description, given by way of example and with reference to the accompanying drawings.

BRIEF DESCRIPTION OF THE DRAWINGS

Exemplary embodiments of the present invention will now be described by way of non-limiting example only, with reference to the accompanying drawings, in which.

DETAILED DESCRIPTION OF THE EMBODIMENTS

Figure 1:
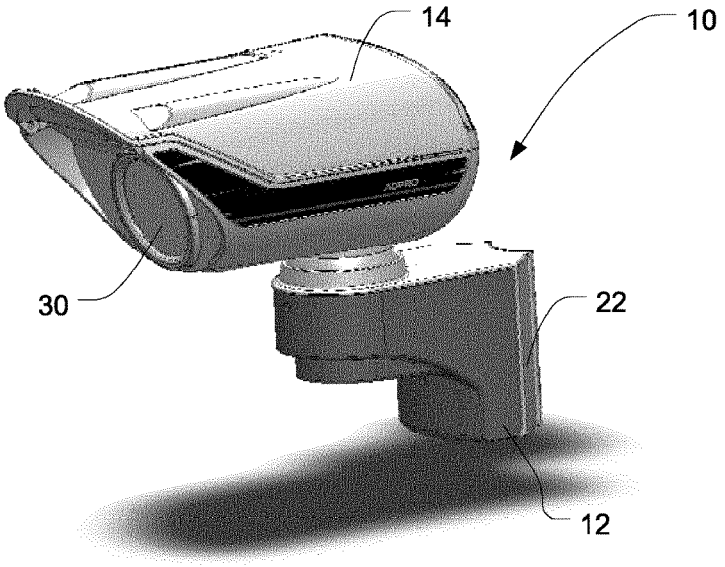
FIG. 1 is a perspective view of an electro-optical detector according to an example embodiment of the invention.
Figure 2:
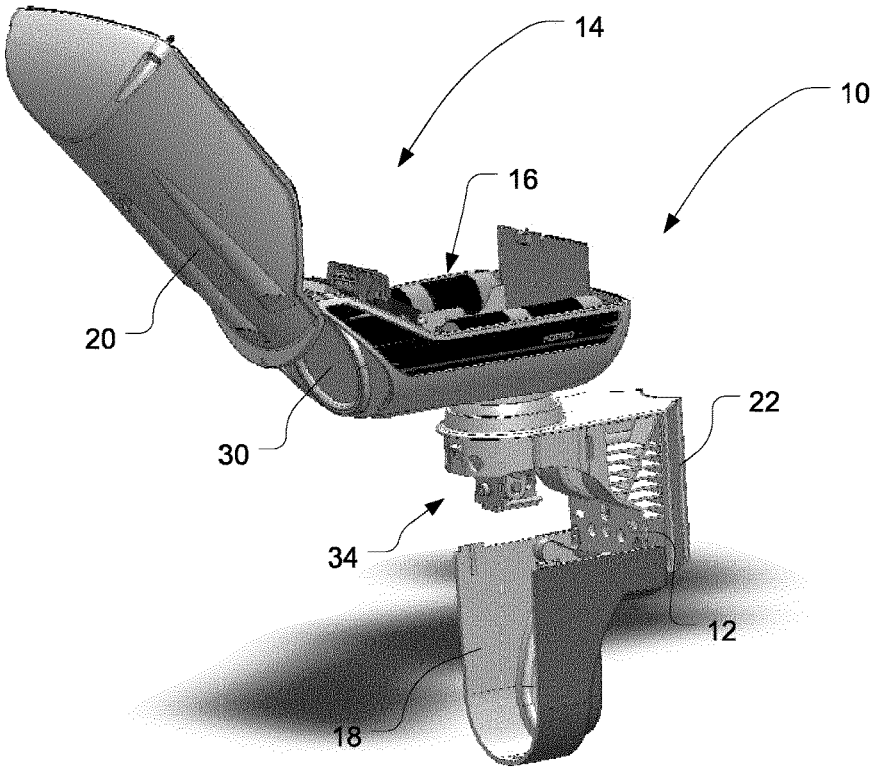
FIG. 2 is a perspective view of the electro-optical detector of FIG. 1 in which respective covers for a detector head and a mounting structure of the detector are open.
Figure 3:
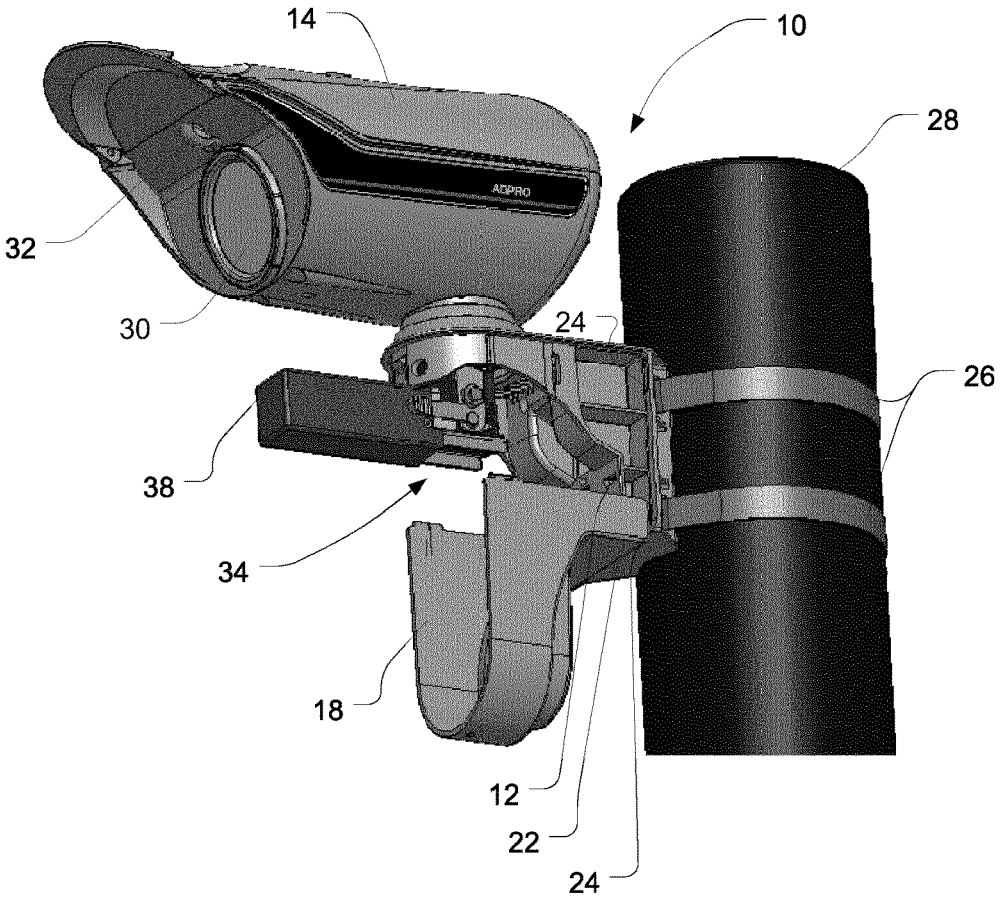
FIG. 3 shows a detachable controller unit in accordance with the invention connected to an adjustment mechanism of the electro-optical detector of FIG. 1, as assembled during commissioning of the detector.

Referring first to FIGS. 1 to 3, an electro-optical detector 10 is shown as a passive infrared (PIR) detector. This type of detector 10 typically forms part of a larger security system and is to monitor a specified area against intrusion.

The detector 10 includes a mounting support 12 adapted to be secured to a fixed structure and a detector head 14 which carries suitable electro-optical detector circuitry 16. As is best seen in FIG. 2, each of the mounting support 12 and the detector head 14 includes a pivotal cover 18 and 20, which provides a user with access to the components of the respective parts.

In this embodiment, the mounting support 12 defines on a terminating side end thereof a securing formation in the form of bracket 22. The bracket 22 has elongate slots 24 (see FIG. 3) through which securing clips 26 may pass in use, thereby to mount the mounting support 12 to a fixed structure such as a pole 28. It will be appreciated that the mounting support 12 may include other securing formations to mount the detector 10 to any suitable fixed structure.

The electro-optical detector circuitry 16 of the detector head 14 includes a passive infrared (PIR) sensor positioned behind a sensor window 30. After commissioning of the detector 10, the PIR sensor monitors a narrow curtain-shaped field of view. This field of view is in effect the field of operation of the detector, i.e., the area for which alarms are to be signalled on intrusion. Additional creep zone sensors 32 (see FIG. 3) are located above the sensor window 30 and are relatively positioned to provide zone protection for an area immediately behind the detector 10.

Once the mounting support 12 is secured to the pole 28, the detector circuitry 16 is connected to the security system via the necessary cabling. A cable entry assembly of the present detector 10 will be described in more detail below.

The mounting support 12 and detector head 14 are adjustably connected to each other through an adjustment mechanism 34 capable of altering the relative position of the detector head 14 during commissioning of the detector 10. In this example embodiment, it is the detector head including electro-optical detector circuitry that is alignable, in particle adjustable with relation to the mounting support. It will however be appreciated that in other example embodiments of the invention the adjustability may be restricted only to a sub-component or sub-system that determines or defines the field of view of the particular detector. For example, the alignable component may alternatively be an optical component or system including a lens, mirror, prism or the like. In this case, it will be the position and/or orientation of the component or system relative to the mounting support that defines a field of view or field of illumination of the alignable component of the detector.

Figure 4:
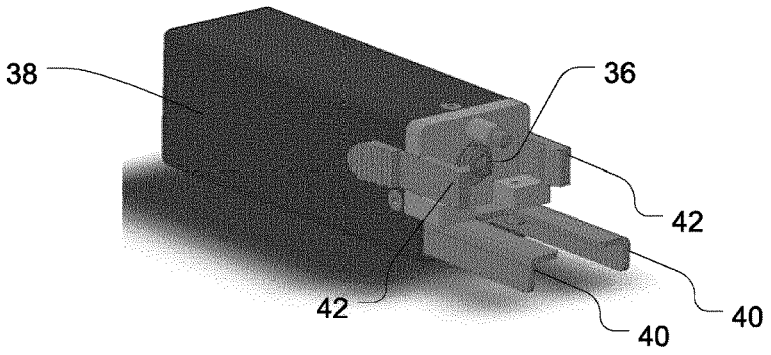
FIG. 4 is a perspective view of the detachable controller unit of FIG. 3.

According to the present embodiment, and now also referring to FIG. 4, the adjustment mechanism 34 is manipulated through interaction with an actuator 36, which actuator 36 is in turn remotely controlled from a communication device (not shown). The adjustment mechanism 34 is mostly used during commissioning of the detector 10 when the field of view of the particular detector 10 is to be set up.

The actuator 36, in this embodiment in the form of a motor drive, is housed in a detachable controller unit 38, which is typically only used during the commissioning of the detector 10. It will be appreciated that any suitable actuator could be used. For example, the actuator may be a battery or locally powered DC motor or stepper motor.

As best shown in FIG. 4, the controller unit 38 has two brackets 40 extending from its lower corners. The brackets 40 are adapted to engagedly fit over the lower end of the adjustment mechanism 34. The controller unit 38 further has two biased clips 42 that hook over a front face edge of the adjustment mechanism 34 thereby to secure and position the controller unit 38 in place on the adjustment mechanism 34. Once so aligned, the motor drive 36 of the controller unit 38 is to interact and mechanically engage with an adjustment screw 44 of the adjustment mechanism 34 (with reference to FIGS. 5 to 7). In interacting with the adjustment screw 44, the motor drive 36 alters the detector head's relative position to the mounting support 12, as will be described in more detail below.

The detachable controller unit 38 further includes a communication module (not shown), typically a wireless communication module, in order to receive instructions from the remote communication device. Any suitable communications channel could be used for these transmissions, for example Wi-Fi, Bluetooth, or other radio technologies. Depending on the specifics of the security system, transmissions between the remote communication device and the detachable controller unit may be secured through methods and protocols well-known in the art.

Figure 5:
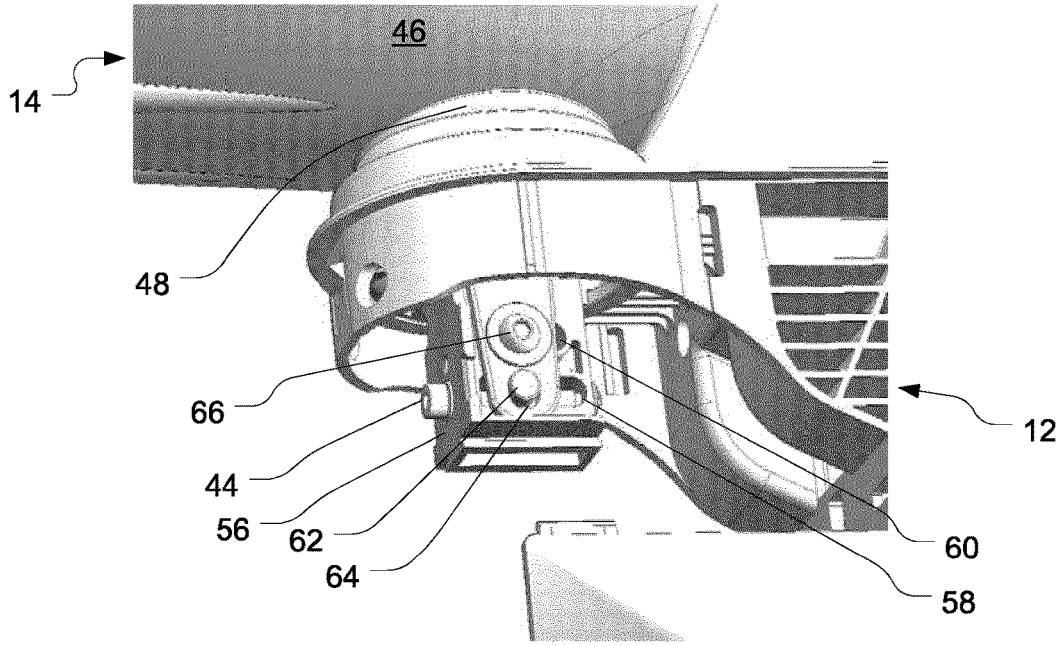
FIG. 5 is an enlarged partial perspective view of the adjustment mechanism of the electro-optical detector of FIG. 1.
Figure 7:
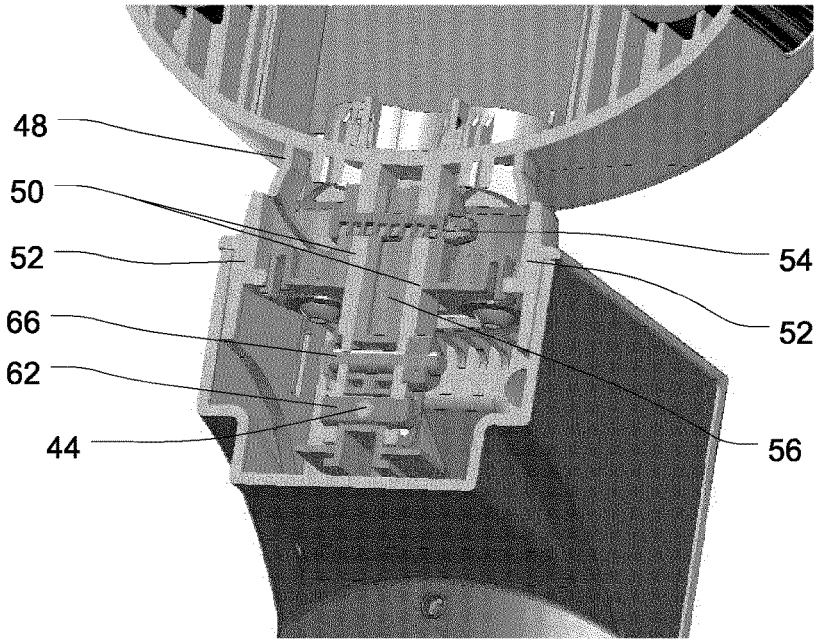
FIG. 7 is a cross-sectional view along a vertical plane intersecting the electro-optical detector of FIG. 1, in particular to show features of the adjustment mechanism.
Figure 6:
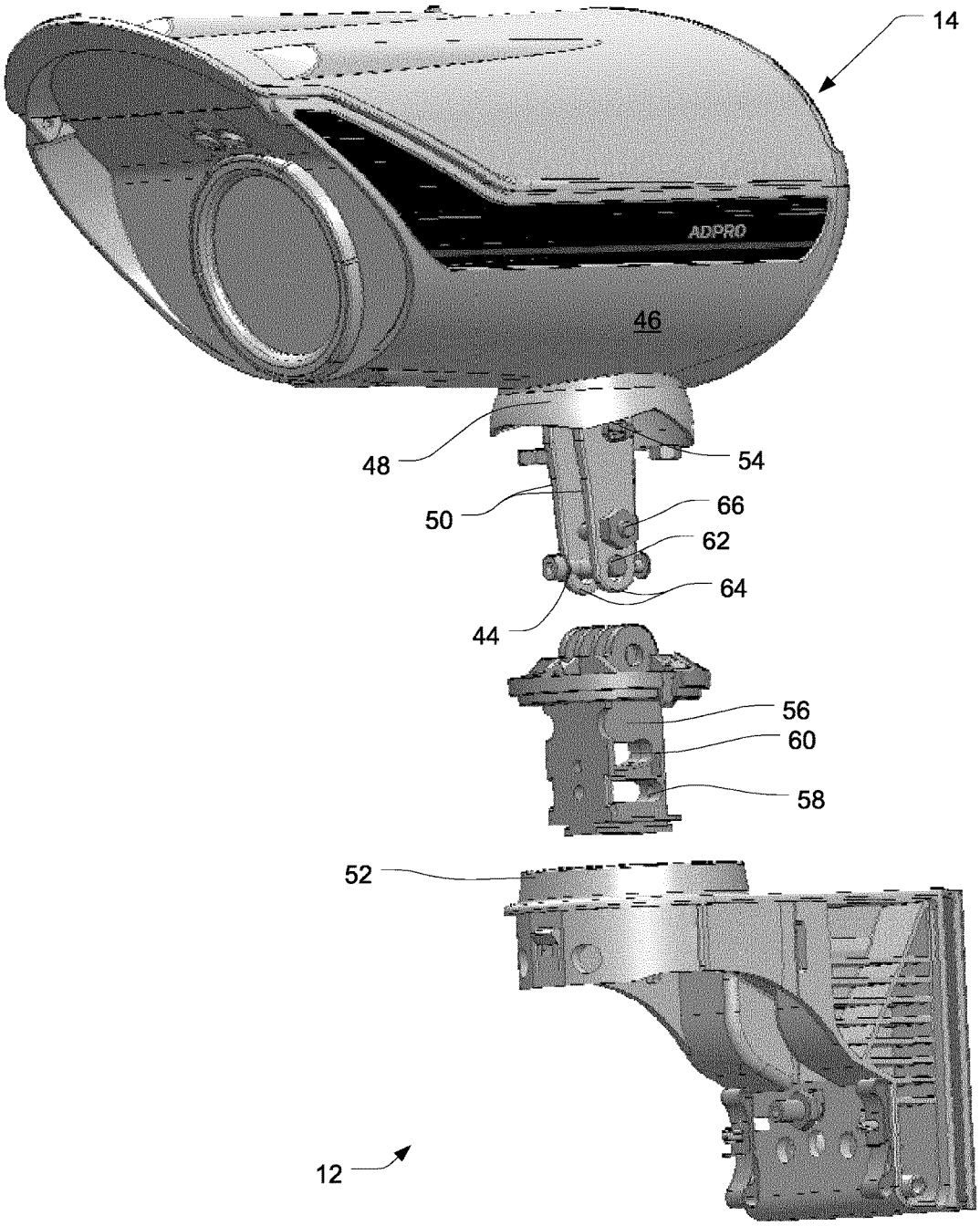
FIG. 6 is a an exploded view of the electro-optical detector of FIG. 1, in which the cover of the mounting structure is open.

Turning now to FIGS. 5 to 7, the adjustment mechanism of the detector 10 is described in more detail. The detector head 14 is shown to include a lower housing 46 which terminates on its lower end in a downwardly extending formation comprising a neck 48 and two central levers 50 that together form a U-shaped lever bracket.

In turn, the mounting support 12 terminates in an upper end which defines a collar 52. The neck 48 of the detector head 14 fits into the collar 52 of the mounting support 12 thereby for the neck 48 and collar 52 to form a ball-socket type of arrangement.

Fixedly secured to the detector head 14, via a pivot shaft 54 located between the two opposing levers 50, is a swivel component 56. The swivel component 56 defines across its width a first and a second guide 58 and 60, with the adjustment screw 44 being at least partially located and secured in place in the first guide 58. The adjustment screw 44 has a cross-bar 62 which extends, from side to side, through the first guide 58. The ends of the cross-bar 62 are connected to the levers 50 of the U-shaped bracket, as the ends pass through apertures 64 defined in the lower part of the levers 50. Similarly, and for additional support, a bolt 66 is also secured between the two levers 50, with this bolt 66 being movable along the second guide 60. Thus, through these connections the adjustment screw 44 is movably fixed to both the swivel component 56 and the levers 50 of the detector head 14.

In operation, the adjustment screw 44 is engaged by the actuator 36 of the controlling unit 38. The actuator 36 accordingly drives the adjustment screw 44, resulting in the cross-bar 62 of the adjustment screw 44 being moved along the guide 58 of the swivel component 56. At the same time, the bolt 66 is moved along the second guide 60. As the cross-bar 62 slides along the guide, the detector head 14 pivots around the pivot shaft 54, forcing the detector head 14 to tilt upward or downward, depending on the direction of movement of the cross-bar 62.

In this embodiment of the invention, the adjustment mechanism 34 is thus a combination of the swivel component 56 and those parts that interact with it, i.e. the neck 48 and levers 50 of the detector head 14, the collar 52 of the mounting support 12 and the adjustment screw 44 with the cross-bar 62 and bolt 66.

As the adjustment is dependent on the driving of the adjustment screw 44, the adjustment mechanism cannot be actuated once the detachable controller unit 38 has been removed. Thus, the detector head 14 is locked in place after commissioning and on removal of the detachable controller unit 38.

In the embodiment described in relation to FIGS. 1 to 7 only one axis of movement is adjustable. However, the present invention extends to detectors that include adjustment mechanisms capable of adjusting multiple axes of movement. For example, by adapting the actuator of the controller unit and the adjustment mechanism connecting the alignable component with the mounting support, it would be possible to remotely adjust both the vertical and horizontal alignment of a detector.

Additionally, although the electro-optical detector described above is a PIR detector, the invention is not limited to this type of detector. As mentioned briefly above, the detector could extend to detectors comprising an optical component or system including a lens, mirror, prism or the like to monitor a field of view.

The detector may also be a combination detector-camera that includes PTZ (pan-tilt-zoom) functionality. It is envisioned that such PTZ functionality will be independent of the adjustment made by the commissioning module. That is, remote commissioning for the detector head or detector components will take place and such components will be locked in place once the controller unit is removed from the detector. The automated pan-tilt-zoom of the camera is to occur while the detector head or detector components remains so locked in place.

Figure 8:
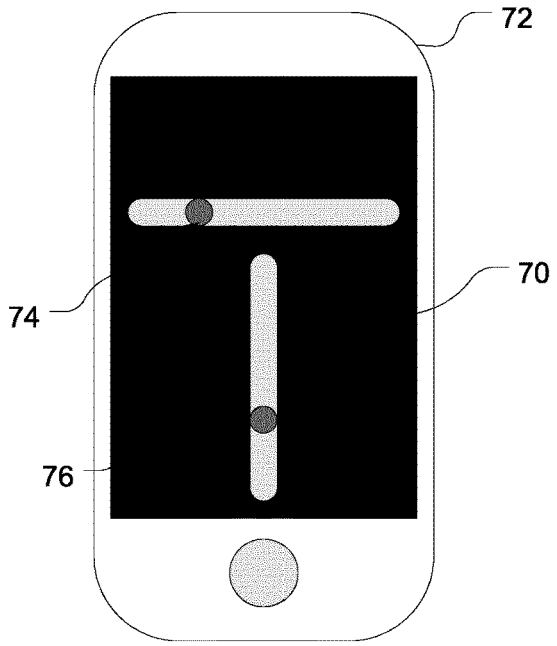
FIG. 8 shows an example graphical user interface as displayed on a smart phone, in accordance with the invention.

The remote communication device, from which the detachable controller unit 38 receives its instructions, is typically small, hand-held and portable, e.g., a mobile telephone, tablet or any other portable computing device with suitable communication functionality. A commission module in the form of a software program or application is installed and executed on the communication device. The commissioning module provides functionality to the remote communication device which allows a user to remotely commission the detector 10, in particular to change the relative position of the detector head 14. For example, the commissioning module may provide a user interface configured to receive touch inputs from a user. An example graphical user interface 70 for adjusting the alignment of a detector is shown in FIG. 8. The user interface 70, shown on a smart phone 72, comprises two sliders 74 and 76 respectively to adjust the horizontal and vertical alignment of the detector. The use of sliders make it easy and convenient for a user to make the necessary adjustments with one hand. User interfaces may be adapted according to the needs of the particular security system. Once the inputs are processed as instructions and transmitted to the detachable controller unit 38, the actuator is driven and adjustments made.

It will be appreciated that the commissioning module may also be integrated and employed with other existing devices, e.g., with cordless walk testers which are well known in the security field. Alternatively, the functionality of cordless walk testers (which may include indicators for power levels, battery power, communication links with the detector and LED lights to show when the alarm has been activated) could be incorporated as further software modules with the commissioning module. This will allow centralised commissioning functionality that could be run as a single software application on any of the abovementioned remote communication devices.

Figure 9:
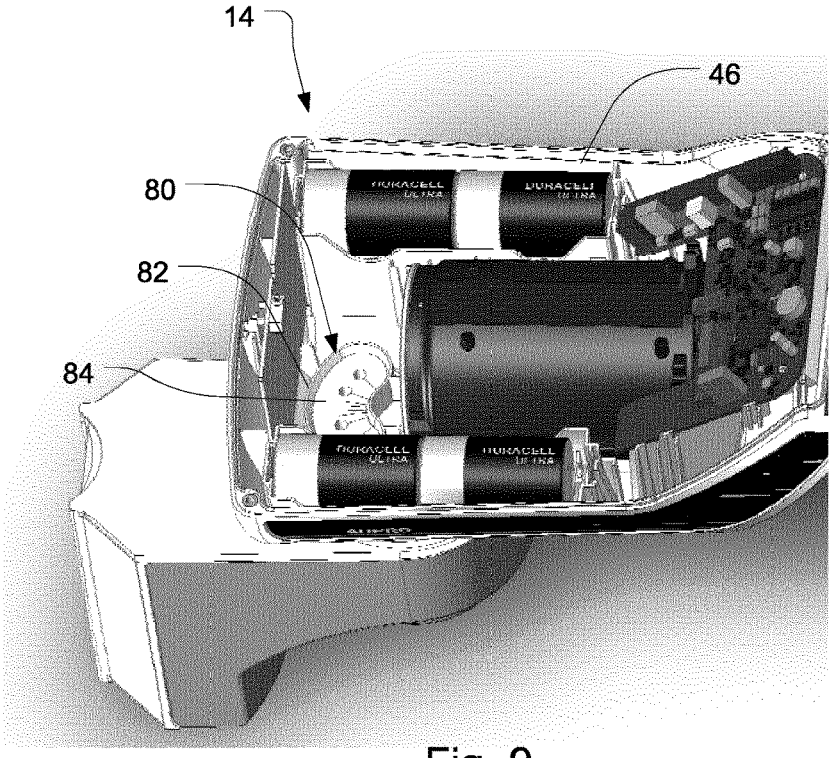
FIG. 9 is a perspective view of the detector head of FIG. 1, exposing a cable gland assembly in accordance with an example embodiment of the present invention.
Figure 10:
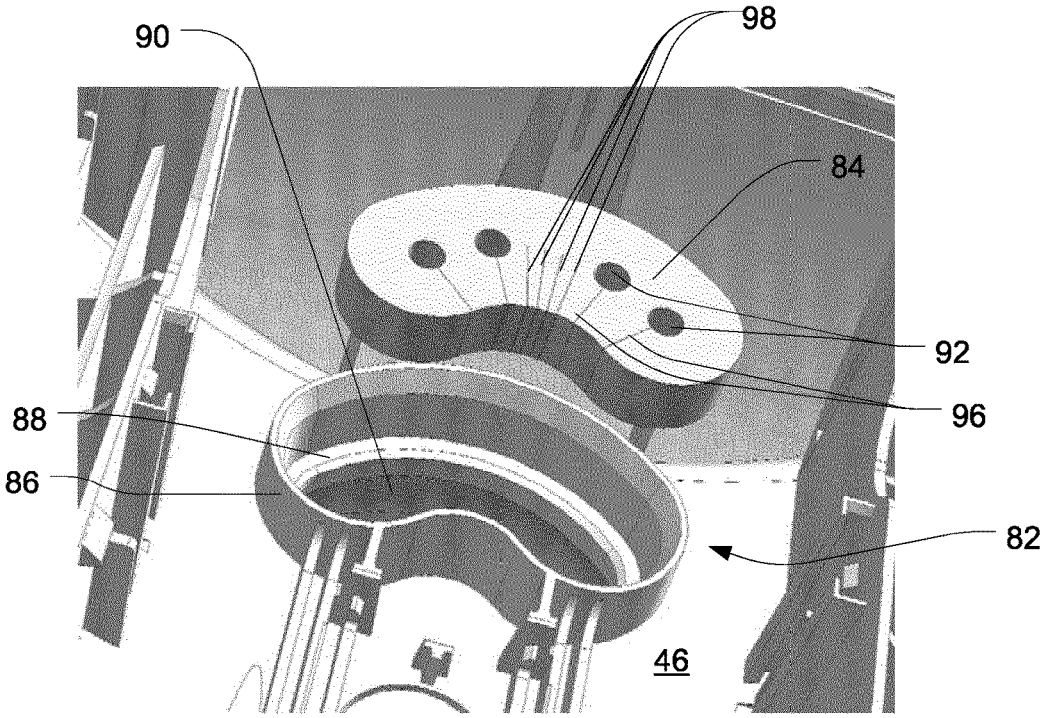
FIG. 10 shows a partial exploded view of the cable gland assembly of FIG. 9.
Figure 11:
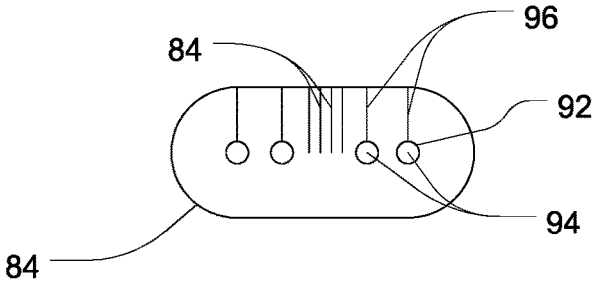
FIG. 11 shows a pictorial view of the cable gland of FIGS. 9 and 10.

Turning now to FIGS. 9 to 11, a cable gland assembly 80 according to the present invention is described in more detail. The cable gland assembly 80 is located in the lower housing 46 of the detector head 14 and comprises an internal seat 82 which receives a cable gland 84 in use. The seat 82 is defined in a side wall of the lower housing 46 and extends inwardly into the cavity of the detector head 14. In particular, the seat 82 has a surrounding outer wall 86 and an inner rim 88 which together allows the seat 82 to provide a snug fit to the cable gland 84.

The inner rim 88 of the seat 82 defines a cable entry passage 90 into the interior of the detector head 14. The passage 90 is to be sufficiently large to enable multiple cables, with their end connectors in place, easily to pass through the passage during installation of the cables.

The cable gland 84 is made from a deformable and flexible material. In this embodiment it is manufactured from rubber. It will however be appreciated that the gland could easily be manufactured from any other suitably flexible material.

The cable gland is manufactured to define one or more cable ducts 92 therein, although each cable duct 92 has a duct stop 94 secured in it. Each duct stop 94 acts as a plug and assists in keeping its associated cable duct 92 closed when not yet used. During installation, a user is to remove (e.g., cut out) the respective duct stops 92 prior to fitting the cable duct 92 around a cable section.

Each cable duct 92 is connected to the outer periphery of the cable gland by a duct connector slot 96. These slots 96 are merely a cut in the gland which allows a user to slide a cable section into the cable duct 92. The cable gland 84 includes a couple of additional compression slits 98. As is described below, these slits 98 assists in biasing the cable ducts 92 and connector slots 96 closed.

The seat 82 and cable gland 84 is typically shaped and sized for the seat to snugly receive the cable gland 84 in use. This ensures that the cable gland 84 remains in position in the seat 82 during use, ensures that the cables are secured in position and that there is limited ingress of dirt, dust or moisture into the housing. The seat 82 and cable gland 84 are typically shaped and sized in a configuration which forces the cable ducts 92 surrounding cables, cable ducts 92 with the duct stops 94, and connector slots 96 closed, e.g., biasing the gland closed.

As is shown in FIG. 11, the gland 84 of the present invention has an oval type shape. However, as the seat 82 is kidney shaped, the cable gland 84 is received in the seat in a deformed configuration, thereby forcing the bias of the gland 84. The ducts 92, slots 96 and slits 98 are forced closed, resulting in a very good seal.

The diameter of the cable ducts 92 defined in the gland 84 is typically chosen to be less than the diameter of a cable to be received by the cable duct 92. This further ensures that the cables fit very snugly in the gland without any unnecessary openings.

The cable gland assembly 80 provides an easy and convenient way of connecting cables to the detector 10. Cables, together with their connecting plugs, are passed through the passage 90. On the inner end, the cables are fitted into cable gland 84 once the respective duct stops 94 have been removed. Once all the cables have been passed through the cable gland 84, the gland is deformed and received in the internal seat.

It will be understood that the invention disclosed and defined in this specification extends to all alternative combinations of two or more of the individual features mentioned or evident from the text or drawings. All of these different combinations constitute various alternative aspects of the invention.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. An electro-optical detector including:

a mounting support adapted to be secured to a fixed structure;

an alignable component, the alignable component being connected to the mounting support through an adjustment mechanism capable of altering the relative position of the alignable component during commissioning of the detector to define a field of view of the detector; and a detachable controller unit including a communication module to receive instructions from a remote communication device in response to which the adjustment mechanism alters the alignable component's position relative to the mounting support.

2. The electro-optical detector as claimed in claim 1 wherein the detachable controller unit includes an actuator driven in response to the received instructions and interacting with the adjustment mechanism of the detector.

3. The electro-optical detector as claimed in claim 2 wherein the actuator is a motor drive.

4. The electro-optical detector as claimed in claim 2 wherein the actuator is configured to mechanically engage with the adjustment mechanism of the detector.

5. The electro-optical detector as claimed in claim 1 wherein the adjustment mechanism locks the alignable component in place on removal of the detachable controller unit.

6. The electro-optical detector as claimed in claim 1 wherein the communication module is a wireless communication module.

7. The electro-optical detector as claimed in claim 1 wherein the alignable component is a detector head including electro-optical detector circuitry having a field of view, wherein the position and/or orientation relative to the mounting support defines a field of view of the alignable component of the detector.

8. The electro-optical detector as claimed in claim 1 wherein the alignable component is an optical component or system including a lens, mirror, prism or the like, wherein the position and/or orientation relative to the mounting support defines a field of view or field of illumination of the alignable component of the detector.

9. A commissioning tool kit for an electro-optical detector including a mounting support and an alignable component connected to each other through an adjustment mechanism configured to alter the relative position between the mounting support and alignable component to define a field of view of the detector, the commissioning tool kit including:

a commissioning module executable on a remote communication device, the commissioning module configured to receive and process inputs to control an orientation of the alignable component from a user, the commissioning module further adapted to communicate the inputs as instructions to a detachable controller unit, and a detachable controller unit configured to be connectable to the electro-optical detector, the controller unit including a communication module to receive the instructions from the remote communication device in response to which the adjustment mechanism is controlled.

10. The commissioning tool kit as claimed in claim 9 wherein the detachable controller unit includes an actuator driven in response to the received instructions and interacting with the adjustment mechanism of the detector.

11. The commissioning tool kit as claimed in claim 10 wherein the actuator is a motor drive.

12. The commissioning tool kit as claimed in claim 10 wherein the actuator is configured to mechanically engage with the adjustment mechanism of the detector.

13. The commissioning tool kit as claimed in claim 10 wherein the alignable component is a detector head including electro-optical detector circuitry having a field of view, wherein the position and/or orientation relative to the mounting support defines a field of view of the alignable component of the detector.

14. The commissioning tool kit as claimed in claim 10 wherein the alignable component is an optical component or system including a lens, mirror, prism or the like, wherein the position and/or orientation relative to the mounting support defines a field of view or field of illumination of the alignable component of the detector.

15. A method of commissioning an electro-optical detector, the method including, at a mounted electro-optical detector, connecting a detachable controller unit to an adjustment mechanism of the detector;

at the detachable controller unit, receiving instructions to adjust the relative position of the detector from a remote communication device;

in response to the received instructions, driving an actuator that interacts with the adjustment mechanism to alter the detector's relative position thereby to adjust the field of view of the detector; and removing the detachable controller unit from the adjustment mechanism.

* * * * *